United States Patent [19]

Wenstadt

[11] Patent Number: 4,950,191

[45] Date of Patent: Aug. 21, 1990

[54] WATER JACKETED EXHAUST RELIEF SYSTEM FOR MARINE PROPULSION DEVICES

[75] Inventor: Thomas D. Wenstadt, Mobile, Ala.

[73] Assignee: Outboard Marine Corporation, Waukegan, Ill.

[21] Appl. No.: 219,409

[22] Filed: Jan. 25, 1988

Related U.S. Application Data

[62] Division of Ser. No. 754,534, Jul. 12, 1985.

[51] Int. Cl.[5] ..... B63H 21/26

[52] U.S. Cl. ..... 440/89; 440/78

[58] Field of Search ..... 440/88, 89, 76, 78; 181/39

[56] References Cited

U.S. PATENT DOCUMENTS

| | | | |
|---|---|---|---|
| 3,310,022 | 3/1967 | Kollman | 440/89 |
| 4,421,490 | 12/1983 | Nakahama | 440/88 |
| 4,507,092 | 3/1985 | Hall et al. | 440/89 |

*Primary Examiner*—Joseph F. Peters, Jr.
*Assistant Examiner*—Jesûs D. Sotelo
*Attorney, Agent, or Firm*—Michael, Best & Friedrich

[57] ABSTRACT

The outboard motor comprises a propulsion unit including an engine, an adaptor fixedly connected between the engine and a lower unit including an outer drive shaft housing, a gear case fixedly connected to the drive shaft housing and including a water discharge passage having a discharge port adapted to communicate with the water in which the lower unit is submerged for operation and an inner housing inside the drive shaft housing and spaced therefrom to define a lower unit water jacket and also defining an exhaust gas expansion chamber communicating with the engine exhaust. The inner housing includes a duct having an upper end communicating with the lower unit water jacket and into which overflow water from the lower unit water jacket is discharged and also having a lower end communicating with the gear case water disharge passage. A cover covering the engine and the adaptor includes a lower section having an exhaust gas discharge port which is located above the upper end of the drive shaft housing and which is connected in communication with the engine exhaust by a conduit means including a portion of the inner housing extending downwardly to a location located below the upper end of the duct, at least one pocket on the interior of the inner housing and having an open upper end located above the upper end of the duct, an aperture in the inner housing connecting the interior of the pocket in communication with the lower unit water jacket at a location below the upper end of the duct, a passageway in the adaptor communicating with the lower unit water jacket, and a conduit connecting the adaptor passageway in communication and the exhaust gas discharge port.

9 Claims, 2 Drawing Sheets

WATER JACKETED EXHAUST RELIEF SYSTEM FOR MARINE PROPULSION DEVICES

This is a division of application Ser. No. 754,534, filed July 12, 1985.

BACKGROUND OF THE INVENTION

This invention relates to marine propulsion devices such as outboard motors and stern drive units and, more particularly, to water jacketed exhausted discharge systems including an exhaust gas relief arrangement.

Exhaust gas systems for internal combustion engines of outboard motors typically are exhausted downwardly through a gas expansion chamber in a drive shaft housing and then discharged into the water through a through-the-hub propeller or the like. The exhaust gas expansion chamber is jacketed with water to cool the exhaust gases and muffle sound.

At higher boat speeds, a low pressure region is created behind the gear case and propeller and exhaust gases are easily discharged into the water. At engine idle or lower boat speeds, water backs up through the hub into the exhaust gas expansion chamber and creates a static back pressure which restricts the discharge of the exhaust gases and creates rough engine operating characteristics.

Exhaust relief systems have been provided for venting the exhaust gases to atmosphere through a discharge outlet located in the drive shaft housing during engine idle and low boat speeds.

Examples of prior art constructions including an exhaust release system are disclosed in the following U.S. Pat. Nos.:

| Patentee | Patent No. | Issue Date |
|---|---|---|
| Hulsebus | 3,045,423 | July 24, 1962 |
| Larsen | 3,198,162 | August 3, 1965 |
| Gazzara | 3,282,373 | November 1, 1966 |
| Hoiby et al. | 3,296,997 | January 10, 1967 |
| Kollman | 3,310,022 | March 21, 1967 |
| Boda et al. | 3,350,879 | November 7, 1967 |
| Miller | 3,520,270 | July 14, 1970 |
| Tado | 3,577,952 | May 11, 1971 |
| Miller et al. | 3,911,852 | October 14, 1975 |
| Harralson et al. | 3,967,446 | July 6, 1976 |
| Maier et al. | 4,036,162 | July 19, 1977 |
| Harbert | 4,019,456 | April 26, 1977 |
| Harada | 4,145,988 | March 27, 1979 |
| Sanmi et al. | 4,303,401 | December 1, 1981 |
| Sanmi et al. | 4,354,849 | October 19, 1982 |
| Nakahama | 4,421,490 | December 20, 1983 |
| Hall et al. | 4,507,092 | March 26, 1985 |

SUMMARY OF THE INVENTION

The invention provides a marine propulsion device comprising a lower unit including an outer drive shaft housing, a gear case fixedly connected to the drive shaft housing and including a rotatably mounted propeller and a water discharge passage having a discharge port adapted to communicate with the water in which the lower unit is located for operation, and an inner housing inside the drive shaft housing and spaced therefrom to define a lower unit water jacket communicating with a source of water. The inner housing also defines an exhaust gas expansion chamber communicating with the source of exhaust gas and has a duct including an upper end communicating with the lower unit water jacket and into which water from the lower unit water jacket is discharged and also includes a lower end communicating with the gear case water discharge passage. The marine propulsion device also includes means adapted for supporting the lower unit from a boat transom for vertical swinging movement about a horizontal tilt axis and for horizontal steering movement about a steering axis transverse to the tilt axis.

The invention also provides an outboard motor comprising a propulsion unit including a power head including an engine having an exhaust port and a water jacket discharge port, a lower unit fixedly connected to the power head and including an outer drive shaft housing, a gear case fixedly connected to the drive shaft housing and including a rotatably mounted propeller and a water discharge passage having a discharge port adapted to communicate with water in which the lower unit is submerged for operation, and an inner housing inside the drive shaft housing and spaced therefrom to define a lower unit water jacket communicating with the engine water jacket discharge port. The inner housing also defines an exhaust gas expansion chamber communicating with the engine exhaust port and has a duct including an upper communicating with the lower unit water jacket and into which overflow water from the lower unit water jacket is discharged and also includes a lower end communicating with the gear case water discharge passage. The outboard motor also includes means adapted for supporting the propulsion unit from a boat transom for vertical swinging movement about a horizontal tilt axis and for horizontal steering movement about a steering axis transverse to the tilt axis.

In one embodiment, the inner housing and the duct are formed as a one-piece unit.

The invention further provides an outboard motor comprising a propulsion unit including a power head including an internal combustion engine having an exhaust gas passage communicable with the engine, a lower unit fixedly connected to the power head and including a drive shaft housing and a gear case rotatably supporting a propeller, an engine cover mounted in covering relation to the power head and including an exhaust gas discharge port located above the upper end of the lower unit, and conduit means communicating between the exhaust gas passage and the exhaust gas discharge port.

In one embodiment, the power head includes an adaptor fixedly connected between the bottom of the engine and the upper end of the lower unit and the drive shaft housing includes means defining an exhaust gas expansion chamber communicating with an exhaust gas opening in the adaptor, means defining a lower unit water jacket at least partially surrounding the exhaust gas expansion chamber, and means for maintaining the water in the lower unit water jacket at a predetermined level, and the conduit means includes a portion of the exhaust gas chamber extending downwardly to a location below the water level in the lower unit water jacket, a portion of the adaptor, and a conduit between such portion in the adaptor and the exhaust gas discharge port.

In one embodiment, the lower unit includes an inner housing fixedly connected to the lower end of the adaptor and having an outer surface spaced inwardly from the drive shaft housing to define said lower unit water jacket and an inner surface defining said exhaust expansion chamber.

In one embodiment, the conduit means includes a pocket on the inner surface of the inner housing having an open upper end located above the water level in the lower unit water jacket and an aperture in the inner housing connecting the interior of the pocket in communication with the lower unit water jacket at a location below the water level.

In one embodiment, the portion of the adaptor forming part of the conduit means includes an exhaust gas outlet and a passageway communicating with the lower unit water jacket and with the exhaust gas outlet in the adaptor. In addition, a conduit is connected between the exhaust gas outlet of the adaptor and the exhaust gas discharge port of the cover.

One of the principal features of the invention is the provision of a marine propulsion device including an exhaust relief system arranged to prevent submersion of the exhaust gas discharge port during operation.

Another of the principal features of the invention is the provision of such a marine propulsion device wherein the exhaust relief system is arranged to reduce noise during engine idle and lower boat speeds.

A still further of the principal features of the invention is the provision of a marine propulsion device including an exhaust relief system which is arranged to prevent submersion of the exhaust gas discharge port, in combination with a means for maintaining the water level in the lower unit water jacket at a predetermined level to ensure that the exhaust relief system is effective in reducing noise at engine idle and lower boat speeds.

Other features, aspects and advantages of the invention will become apparent to those skilled in the art upon reviewing the following detailed description, the drawings and the appended claims.

Figure 1:
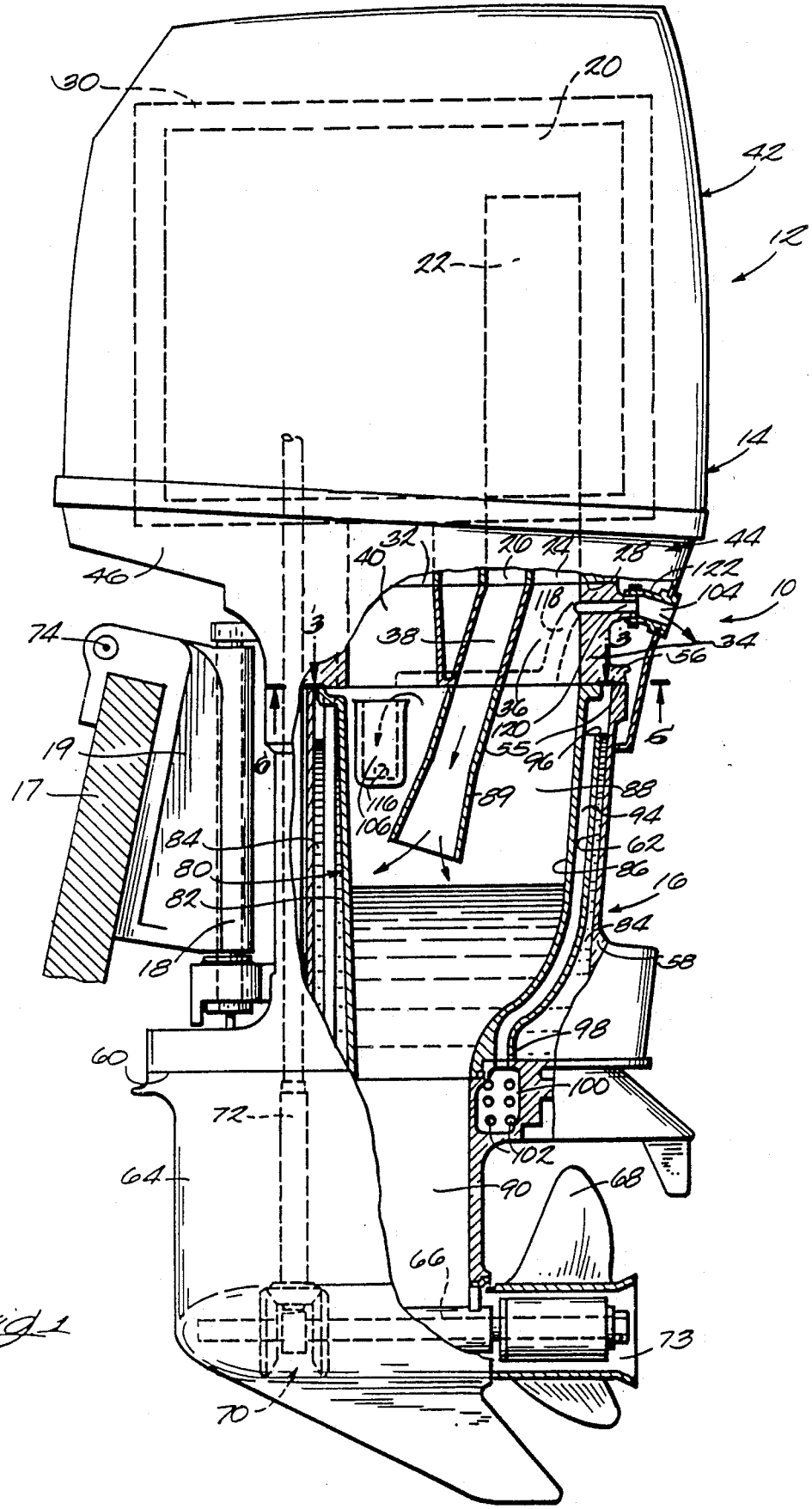
FIG. 1 is a side elevational view, partially broken away and in section, of a marine propulsion device embodying various of the features of the invention.

Before explaining at least one of the embodiments of the in invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENTS

Illustrated in FIG. 1 is a marine propulsion device in the form of an outboard motor 10 having a propulsion unit 12 including, an upper unit or power head 14, and a lower unit 16 fixedly connected to the lower end of the power head 14. In addition, there is provided means adapted for supporting the lower unit 16 from a boat transom 17, including a swivel bracket 18 and a transom bracket 19, for outward swinging movement of the lower unit 16 about a horizontal tilt axis and for horizontal movement about a steering axis transverse to the tilt axis.

The power head 14 includes an internal combustion engine 20 having an exhaust gas system 22 comprising a pair of ports or outlets 24 and 26 in the bottom 28 of the engine 20, as well as a cooling water jacket 30 and a water jacket discharge port 32 in the bottom 28 of the engine. The exhaust gas outlet 24 communicates with one or more cylinders of the engine 20 and the exhaust gas outlet 26 communicates with one or more different cylinders of the engine 20.

The power head 14 also includes an adaptor 34 which is bolted or otherwise fixedly connected to the bottom 28 of the engine 20 and has passages 36, 38, and 40, respectively communicating with the engine exhaust gas outlets 24 and 26 and with the water jacket discharge port 32.

Figure 2:
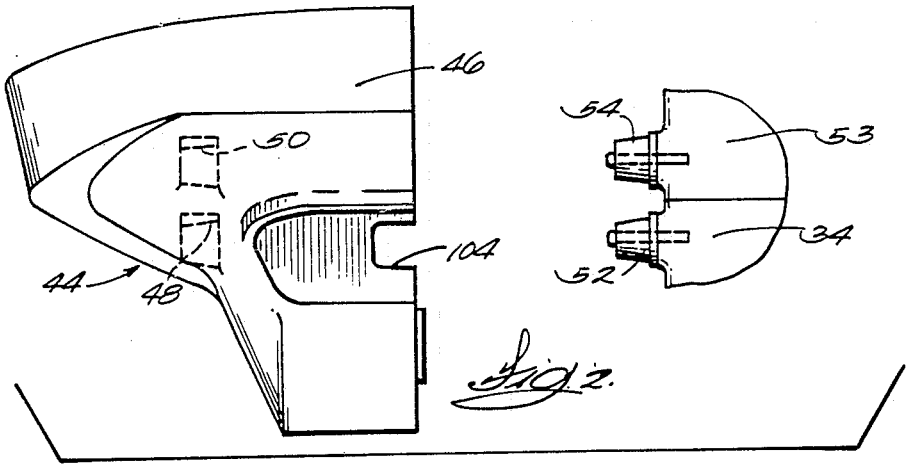
FIG. 2 is a fragmentary, exploded view illustrating the mounting for the lower section of the power head cover.

The power head 14 further includes a housing or cover 42 covering the engine 20 and the adaptor 34 and having a lower section 44 suitably mounted on the power head 14 and/or the lower unit 16. In the specific construction illustrated, the lower housing section 44 (FIG. 2) has two halves 46 (one shown), each half including a pair of apertured lugs 48 and 50 which are slipped onto a resilient mount 52 on the adaptor 34 and onto a resilient mount 54 on the engine block 53, respectively. The two section halves are suitably fastened together, for example, by bolts (not shown), after installation on the adaptor 34 and the engine block 53.

The lower unit 16 has an upper end 55 fixedly connected to the lower end of the power head 14, i.e., to the lower end 56 of the adaptor 34, and further includes an outer drive shaft housing 58 having a bottom 60 and an interior surface 62 and a gear case 64 fixedly connected to the bottom 60 of the drive shaft housing 58. The gear case 64 is submerged in water for operation of the propulsion unit 12 and supports a rotatable propeller shaft 66 carrying a propeller 68.

The gear case 64 houses a suitable reversing transmission 70 which drivingly connects the propeller shaft 66 to a drive shaft 72 which extends through the drive shaft housing 58 and which is drivingly connected to the engine 20. The gear case 62 also includes a lower exhaust gas discharge outlet 73 which, in the specific construction illustrated, is a through-the-propeller hub type. Other conventional types of exhaust gas discharge outlet systems can be used.

The means adapted for providing the vertical and horizontal swinging movement mentioned above includes the transom bracket 19 which is adapted for fixed connection to the boat transom 17 and the swivel bracket 18 which is connected to the transom bracket 19 for vertical tilting movement of swivel bracket about a horizontal tilt axis 74. The lower unit 16, and hence the propulsion unit 12, is connected to the swivel bracket 18 for vertical swinging movement of the propulsion unit 12 about the horizontal tilt axis 74 in common with the swivel bracket 18 and for horizontal steering movement relative to the swivel bracket 18 about a steering axis transverse to the tilt axis 74.

Extending inside the drive shaft housing 58 between the adaptor 34 and the gear case 64 is an inner housing 80 having an outer surface 82 inwardly spaced from the interior surface 62 of the drive shaft housing 58 to define therebetween a lower unit water jacket 84. The inner housing 80 has an inner surface 86 defining an exhaust gas expansion chamber 88 communicating with the engine exhaust gas outlets 24 and 26 via respective adaptor openings 36 and 38 and communicating with the lower exhaust gas discharge outlet 30 via an exhaust gas passageway 90 in the gear case 64. In the illustrated construction, the inner housing 80 is suitably connected, for example by bolts (not shown), to the bottom of the power head 14, i.e., to the lower end 56 of the adaptor 34.

A tuning tube 89 can be connected in communication with one or both of the engine exhaust gas outlets 24 and 26 to produce negative pressure waves in the engine combustion chamber(s) and enhance the amount of fuel introduced into the combustion chamber(s). In the specific construction illustrated, the tuning tube 89 is connected, for example by bolts (not shown), to the lower end 56 of the adaptor 34 and is in communication with the adaptor opening 38.

The water supplied to the lower unit water jacket 84 can be the engine cooling water discharged through the engine water jacket discharge port 32 or can be supplied by other suitable means such as pumping water from outside the drive shaft housing 58 directly into the lower unit water jacket 84.

Mounted on the inner housing 80 is a duct 94 for controlling the water level in the lower unit water jacket 84. The duct 94 has an upper end 96 which communicates with the lower unit water jacket 84 and into which overflow water from the lower unit water jacket 84 is discharged and a lower end 98 which communicates with a water discharge passage 100 in the gear case 64. The gear case water discharge passage 100 includes one or more discharge ports 102 which are located below the water level when the lower unit 16 is submerged for operation.

Mounting the water overflow duct 94 on the inner housing 84 and making it conform to the outer contour of the inner housing 80 saves considerable space inside the drive shaft housing 58. While other arrangements can be employed, in the preferred construction illustrated, the inner housing 80 and the duct 94 are formed as one-piece unit.

When the lower unit 16 is submerged in water for operation, water backs up through the lower exhaust gas discharge outlet 73 into the exhaust gas expansion chamber 88 to a point corresponding to the water level outside the drive shaft housing 58. When the engine is idling or the boat is operating at lower speeds, the exhaust gases must overcome the static pressure caused by this backed-up water in order to be discharged through the lower exhaust gas discharge outlet 73. This back pressure causes rough engine operation. At higher boat speeds, a low pressure region is created behind the gear case 64 and the propeller 68 and this back pressure is eliminated.

The static back pressure problem at engine idling or lower boat speeds is alleviated by providing an exhaust relief system including an upper exhaust gas discharge port or outlet 104 in the engine cover 42. While other constructions can be employed, in the specific construction illustrated, the port or outlet 104 is located in the lower section 44 of the engine cover 42 at a location above the upper end 55 of the lower unit 16, and conduit means connects the upper exhaust gas discharge outlet 104 in communication with the engine exhaust gas outlets 24 and 26.

Figure 3:
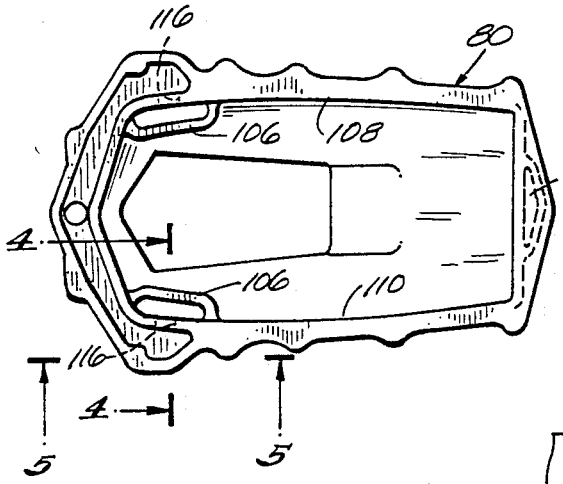
FIG. 3 is a sectional view taken generally along line 3—3 in FIG. 1.
Figure 5:
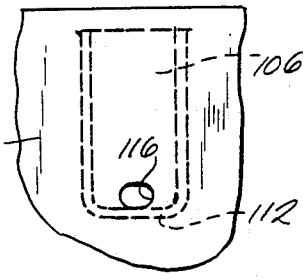
FIG. 5 is a fragmentary, side elevational view taken generally along line 5—5 in FIG. 3.
Figure 4:
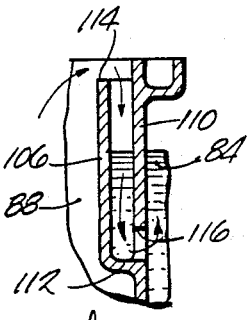
FIG. 4 is a sectional view taken generally along line 4—4 in FIG. 3.

In the specific construction illustrated, this conduit means includes, in part, one or more dams or pockets 106 (FIGS. 3–5) on an interior wall of the inner housing 80. While a different number of pockets can be used and the pockets 106 can be at other locations, in the specific construction illustrated, a pair of pockets 106 are provided on the opposite interior side walls 108 and 110 of the inner housing 80. Each pocket 106 has a closed lower end 112 and an open upper end 114. The conduit means also includes an aperture 116 in each side wall 108 and 110 of the inner housing 80 connecting the respective pocket 106 in communication with the lower unit water jacket 84 at a location below the normal water level in the lower unit water jacket 84 as controlled by the location of the upper end 96 of the duct 94.

Figure 6:
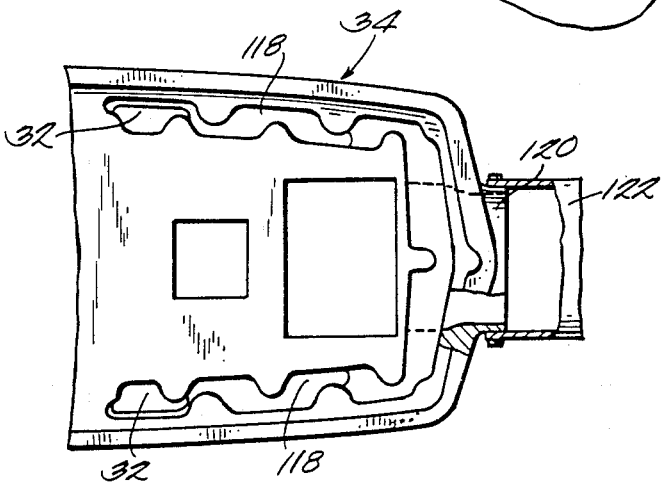
FIG. 6 is a partial bottom view of the adaptor taken generally along line 6—6 in FIG. 1.

The conduit means further includes passageways 118 (FIG. 6) in the lower end of the adaptor 34 communicating with the lower unit water jacket 84 and with an exhaust gas outlet 120 in the adaptor 34. A flexible hose 122 or similar conduit means is connected between the adaptor exhaust outlet 120 and the upper exhaust gas discharge outlet 104 in the lower section 44 of the engine cover 42.

When the engine exhaust gases are discharged through the tuning tube 89 and adaptor opening 36 with water backed up into the exhaust gas expansion chamber 88 as illustrated in FIG. 1, the static back pressure causes them to seek a path of lesser resistance. As illustrated by the arrows in FIG. 1, the exhaust gases enter into the open top end 114 of the pockets 106, travel downwardly through the pockets 106, exit the pockets 106 through the apertures 116, bubble up through the top portion or the water in the lower unit water jacket 84, enter the adaptor passageways 118, passes through the hose 122 and finally are discharged into the atmosphere through the exhaust gas discharge outlet 104.

With this arrangement, the outlet for the exhaust relief system is located where it cannot become submerged during normal operation. Various other exhaust relief system arrangements can also be used for discharging the engine exhaust gases through the exhaust gas discharge outlet 104 above the upper end of the lower unit. For example, in constructions including an exhaust gas relief port in the drive shaft housing, a flexible hose or similar conduit means extending within the engine cover 42 and connected to the exhaust gas discharge outlet can be used.

Various of the features of the invention are set forth in the following claims:

I claim:

1. A marine propulsion device comprising a lower unit including a high-speed exhaust outlet, and a rotatably mounted propeller shaft, a generally vertical conduit communicating with said high-speed exhaust outlet, wall means surrounding said conduit and defining a water jacket between said wall means and said conduit, said water jacket including an exhaust gas passage between said conduit and said water jacket, and a power head drivingly connected to said propeller shaft and including a lower face connected to said lower unit and located in spaced relation to the water in said water jacket, a first exhaust outlet communicating with said conduit, a port located in said lower face and communicating with the space between said lower face and the water in said water jacket, a low-speed exhaust outlet, and a second passage extending interiorly of said powerhead and communicating between said port and said low-speed exhaust outlet.

2. An adaptor for an outboard motor including a lower unit, and an engine having an exhaust outlet, said adaptor comprising an upper face adapted to be connected to the engine and having therein a first exhaust inlet adapted to communicate with the engine exhaust outlet, a lower face adapted to be connected to the lower unit and having therein a first exhaust outlet, a first passage extending interiorly of said adaptor and communicating between said first inlet and said first outlet, a port located adjacent said lower face, a low-speed exhaust outlet, and a second passage extending interiorly of said adaptor and communicating between said port and said low-speed exhaust outlet.

3. An engine assembly for an outboard motor including a lower unit, said engine assembly comprising an engine block having therein an engine exhaust outlet, and an adaptor including an upper face connected to said engine block and having therein a first exhaust inlet communicating with said engine exhaust outlet, a lower face adapted to be connected to the lower unit and having therein a first exhaust outlet, and a first passage communicating between said engine exhaust outlet and said first exhaust outlet, and said engine assembly also comprising a port located adjacent said lower face, a low-speed exhaust outlet, and a second passage extending interiorly of said engine assembly and communicating between said port and said low-speed exhaust outlet.

4. A marine propulsion device comprising a lower unit including a high-speed exhaust outlet, and a rotatably mounted propeller shaft, a generally vertical conduit communicating with said high-speed exhaust outlet, wall means surrounding said conduit and defining a water jacket between said wall means and said conduit, said water jacket including an exhaust gas passage between said conduit and said water jacket, and a power head drivingly connected to said propeller shaft and including a lower face connected to said lower unit and located in spaced relation to the water in said water jacket, a first exhaust outlet communicating with said conduit, a low-speed exhaust outlet, and a second passage extending interiorly of said powerhead and communicating between said low-speed exhaust outlet and the space between said lower face and the water in said water jacket.

5. An adaptor for an outboard motor including an engine having an exhaust outlet, a lower unit having a high-speed exhaust outlet and a rotatably mounted propeller driven by the engine, a generally vertical conduit communicating with the high-speed exhaust outlet, and a water jacket surrounding the conduit and including an upper end, and an exhaust gas inlet communicating with the engine exhaust outlet, said adaptor comprising an upper face adapted to be connected to the engine, a lower face adapted to be connected to the lower unit and located in spaced relation to the water in the water jacket, a first passage adapted to communicate between the engine exhaust outlet and the conduit, a low-speed exhaust outlet, and a second passage extending interiorly of said adaptor, communicating with said low-speed exhaust outlet, and adapted to communicate with the space between said lower face and the water in the water jacket.

6. A marine propulsion device comprising a lower unit including a high-speed exhaust outlet, and a rotatably mounted propeller shaft, a generally vertical conduit communicating with said high-speed exhaust outlet, wall means surrounding said conduit and defining a water jacket between said wall means and said conduit, said water jacket including an exhaust gas passage between said conduit and said water jacket, and a power head drivingly connected to said propeller shaft and including a lower face connected to said lower unit and located in spaced relation to the water in said water jacket, a side face extending upwardly from said lower face, a first exhaust outlet communicating with said conduit, a port located in said lower face and communicating with the space between said lower face and the water in said water jacket, a low-speed exhaust outlet located in said side face, and a second passage communicating between said port and said low-speed exhaust outlet.

7. An adaptor for an outboard motor including a lower unit, and an engine having an exhaust outlet, said adaptor comprising an upper face adapted to be connected to the engine and having therein a first exhaust inlet adapted to communicate with the engine exhaust outlet, a lower face adapted to be connected to the lower unit and having therein a first exhaust outlet, a side face extending between said upper face and said lower face, a first passage extending interiorly of said adaptor and communicating between said first inlet and said first outlet, a port located in said lower face, a low-speed exhaust outlet located in said side face, and a second passage communicating between said port and said low-speed exhaust outlet.

8. A marine propulsion device comprising a lower unit including a high-speed exhaust outlet, and a rotatably mounted propeller shaft, a generally vertical conduit communicating with said high-speed exhaust outlet, wall means surrounding said conduit and defining a water jacket between said wall means and said conduit, said water jacket including an exhaust gas passage between said conduit and said water jacket, and a power head drivingly connected to said propeller shaft and including a portion having a lower face connected to said lower unit and located in spaced relation to the water in said water jacket, a first exhaust outlet communicating with said conduit, a port located in said lower face and communicating with the space between said lower face and the water in said water jacket, a low-speed exhaust outlet, and a second passage communicating between said port and said low-speed exhaust outlet and having a boundary defined at least in part by said portion of said power head.

9. An adaptor for an outboard motor including a lower unit, and an engine having an exhaust outlet, said adaptor comprising an upper face adapted to be connected to the engine and having therein a first exhaust inlet adapted to communicate with the engine exhaust outlet, a lower face adapted to be connected to the lower unit and having therein a first exhaust outlet, a portion between said upper and lower faces, a first passage extending interiorly of said adaptor and communicating between said first inlet and said first outlet, a port located in said lower face, a low-speed exhaust outlet, and a second passage communicating between said port and said low-speed exhaust outlet and having a boundary defined at least in part by said portion of said adaptor.

* * * * *